US005339886A

United States Patent [19]

Key et al.

[11] Patent Number: 5,339,886

[45] Date of Patent: Aug. 23, 1994

[54] METHOD AND APPARATUS FOR TRIMMING EDGE SCRAP FROM CONTINUOUSLY CAST METAL STRIP

[75] Inventors: James C. Key; George A. Sloan, both of Garland County, Ark.

[73] Assignee: Reynolds Metals Company, Richmond, Va.

[21] Appl. No.: 3,069

[22] Filed: Jan. 11, 1993

[51] Int. Cl.[5] ..... B22D 11/06

[52] U.S. Cl. ..... 164/463; 164/423; 164/472; 164/268

[58] Field of Search ..... 164/463, 423, 479, 429, 164/72, 417, 477, 268, 472

[56] References Cited

U.S. PATENT DOCUMENTS 4,155,397 5/1979 Honsinger et al. .
4,197,146 4/1980 Frischmann .
4,343,347 8/1982 Liebermann et al. .
4,408,653 10/1983 Ninart et al. .
4,527,613 7/1985 Bedell et al. .
4,650,618 3/1987 Heinemann et al. .
4,828,012 5/1989 Honeycutt, III et al. .
4,896,715 1/1990 Honeycutt .
4,934,443 6/1990 Honeycutt, III et al. .
4,940,077 7/1990 Honeycutt, III et al. .
4,945,974 8/1990 Honeycutt, III .
4,955,429 9/1990 Honeycutt, III et al. .
4,982,780 1/1991 Stepanenko et al. .

FOREIGN PATENT DOCUMENTS 6356337 3/1988 Japan .
9112910 9/1991 PCT Int'l Appl. .

*Primary Examiner*—Kuang Y. Lin
*Attorney, Agent, or Firm*—Robert C. Lyne, Jr.

[57] ABSTRACT

A method and apparatus for trimming edge scrap from continuously cast metal strip includes an edge trimming device in combination with a drag casting apparatus for producing aluminum or aluminum alloy cast strip. The edge trimming device includes a tool which marks the casting surface of the casting wheel to disruption the solidification rate during casting of the molten aluminum. Disruption of the solidification rate forms a longitudinal split in the strip being cast resulting in formation of a high quality cast strip product acceptable for further processing and edge trim scrap. The edge trim scrap may be recovered and recycled for further use. The edge trimming device includes adjustable features to permit varying the location of the longitudinal split along the width of the strip being cast in response to casting parameters such as excess gauge variation, surface defects or changing of the cast strip width prior to or during the continuous casting operation.

13 Claims, 3 Drawing Sheets

METHOD AND APPARATUS FOR TRIMMING EDGE SCRAP FROM CONTINUOUSLY CAST METAL STRIP

FIELD OF THE INVENTION

The invention relates to a method and apparatus for trimming edge scrap from continuously cast metal strip, and in particular, disrupting the solidification rate of the metal being cast to form a pair of longitudinal splits spaced from the cast strip edges to trim edge scrap and produce a high quality cast strip of a preselected width.

BACKGROUND ART

In the prior art, it is known to produce aluminum in coil form from a continuous casting apparatus wherein molten aluminum is delivered from a tundish and cast in the form of a metal sheet or strip and wound on a coiler. Generally, in this process, molten aluminum is deposited on a moving chill surface from a tundish having an open outlet. An inlet is provided for the flow of molten metal into the tundish from a source of molten metal. The direct casting of the molten aluminum metal onto a chill wheel, preferably a grooved chill wheel, produces a cast aluminum product at a rapid rate. The aluminum cast strip is wound on a coiler in heated form, generally at a temperature in the range of about 400°–1000° F.

Drag casting apparatus and methods of this type are described, for example, in U.S. Pat. Nos. 4,828,012, 4,896,715, 4,934,443, 4,934,443, 4,945,974, 4,940,077 and 4,955,429. The disclosures of these patents are hereby specifically incorporated by reference with respect to the method and apparatus for the production of aluminum strip and coil from molten aluminum or aluminum alloys.

With reference now to FIG. 1, a continuous casting apparatus is illustrated which is typical of prior art continuous casting apparatus using a driven chill surface. The continuous casting apparatus is generally designated by the reference numeral 10 and is seen to include a tundish 1 positioned adjacent a driven chill surface 3. The chill surface 3 comprises the external cylindrical surface of a casting wheel 5. The casting wheel 5 is internally cooled with circulating water or other conventional cooling fluids to extract heat through the chill surface 3 so as to solidify molten metal 7 exiting the tundish 1. A rotary brush 18 contacts the chill surface 3 to remove debris and other impurities prior to contact with the molten metal.

The casting wheel 5 is supported by journal bearings 9 for rotation about a fixed horizontal axis. The journal bearings 9 are supported on the supporting frame 11 which supports both the bearings and the tundish 1. Although not shown, the bearings and tundish may be supported by separate framework. The casting wheel may be driven by a suitable drive means such as a variable speed motor and reduction gear mechanism, not shown, and a drive chain or belt 13 engaging the casting wheel 5.

After the molten metal 7 contacts the chill surface 3 and is solidified as a strip 15, a coiling apparatus 17 accumulates the strip in coil form for further processing. The cooling apparatus may include roller 23 to guide the cast strip to the coiler.

The continuous casting apparatus 10 may also include a burner 19 to selectively apply heat to the chill surface at a location beneath the tundish 1. In addition, a top roll 21 may be provided which is uncooled or heated, the top roll being mounted for rotation in contact with the molten metal prior to complete solidification of the strip.

In order to properly coil the as-cast strip or further work the cast strip made by the apparatus of FIG. 1 into a product having a satisfactory quality, it is important to provide a cast strip leaving the casting surface having a proper shape or cross-sectional profile.

Difficulties have been encountered in prior art processes in achieving acceptable cast strip cross-section profiles in drag casting of aluminum products. Delivering molten aluminum from a tundish onto a moving chill roller surface produces a sheet product having an increased thickness at the edges thereof. This increased thickness is a result of a faster cooling rate at the edges of the chill surface and a corresponding "dog-bone" effect, or washboard or wavy edge. This condition prevents effective coiling of the cast strip and causes difficulties in further reducing the cast strip in subsequent rolling operations. Cold rolling of sheet or strip product generally requires that the sheet or strip have a slightly thicker center portion than edge portion. Strip having a "dog-bone" shape generally has thick edge portions and a thinner center section.

Besides the problems of inconsistent gauge and shape control, the prior art drag casting apparatus are not adapted to continuously cast metal strip having varying strip widths. In order to change widths, the casting operation must be halted so that a different width tundish may be utilized during the subsequent casting operation.

Accordingly, a need has developed to provide improvements in drag casting of molten metals such as aluminum alloys to continuously cast strips of different widths, wherein the cast strip has acceptable gauge and shape profiles.

In the prior art, it is well known to mechanically slit certain gauges of strip product to remove off-gauge edge material, edge cracking or surface imperfections prior to further processing or shipping to a customer. However, in melt drag casting of aluminum or aluminum alloys, the coiled cast strip is wound at temperatures around 400°–1000° F. These high temperatures restrict the use of mechanical devices contacting the cast strip.

Also in the prior art, and in the field of rapid solidification processing, it is known to continuously cast amorphous type materials while modifying the casting surface to modify the shape of the cast product.

In U.S. Pat. No. 4,197,146 to Frischmann, oblate spheroid segments of an amorphous magnetic material are produced by a rapid solidification process. During the rapid solidification, india ink is applied to a chill roll to define the desired shape and size of the particles to be cast. The alloy melt that makes contact with the ink cools more slowly and causes the metal to separate in the desired form and shape.

U.S. Pat. No. 4,343,347 to Liebermann et al. discloses another rapid solidification method forming a metallic ribbon having cutout patterns therein. A plurality of lines which define the geometric configuration of the cutout are made on the casting surface using a sharp-edged tool or silk screening ink. The line provide a differential cooling rate between the molten metal cast on the lines and the metal cast on the unaltered casting surface.

U.S. Pat. No. 4,155,397 to Honsinger et al. discloses another rapid solidification process forming an amorphous metal alloy. In this patent, the chill roll includes a thermal insulator insert which provides the differential cooling rate to permit casting the patterned amorphous ribbon.

U.S. Pat. No. 4,650,618 to Heinemann et al. discloses an apparatus for producing amorphous strip utilizing projecting areas or recesses in the casting surface to cast a predetermined shape. The projecting areas may be configured as ribs running longitudinally or transversely on the casting surface. The recesses may be circular or randomly shaped.

U.S. Pat. No. 4,982,780 to Stepanenko et al. relates to another continuous casting apparatus, in particular, for producing amorphous metal filaments. In this apparatus, metal filaments having varying widths are produced using a plurality of chilled surfaces rotating in different directions or at different speeds.

U.S. Pat. No. 4,408,653 to Nienart et al. also discloses the use of grooves on a chill surface to produce a particularly shaped continuously cast ribbon or shard.

In the field of twin belt continuous casting, International Publication Number WO 91/12910 to Hugens produces discrete molded shapes by modifying the surface of the casting belts. Japanese Patent Number 63-56337 to Tsuchida casts narrow-width metallic sheet using a cooling roll having spaced apart slit grooves to form the narrow-width sheets.

U.S. Pat. No. 4,527,613 to Bedell et al. discloses another conventional casting apparatus which utilizes a gaseous media to produce a continuous slit line along the cast ribbon length.

However, none of the prior art discussed above addresses the problem of excessive gauge variation on cast strip edges or difficulties in changing cast strip width during melt drag casting of aluminum or aluminum alloys.

In response to this need, the present invention provides a method and apparatus for continuously trimming edge scrap from continuously melt drag cast metal strip. Moreover, the inventive method and apparatus permit adjusting the cast strip width while maintaining continuity of the casting operation.

SUMMARY OF THE INVENTION

It is accordingly a first object of the present invention to provide a method and apparatus for trimming edge scrap from continuously cast metal strip.

Another object of the invention is to control cast strip width prior to and during the continuous casting operation.

A further object of the present invention is to eliminate edge defects and gauge variation in a continuously cast coil product to facilitate further processing.

Other objects and advantages of the present invention will become apparent as the description thereof proceeds.

In satisfaction of the foregoing objects and advantages, the present invention comprises a continuous casting apparatus comprising a tundish for receiving molten metal and for delivering the molten metal to a single rotating casting wheel having a chill casting surface of a selected width, wherein molten metal contacts the unitary rotating casting wheel and is cast as a continuous cast strip, and means for separating the cast strip into at least two portions by disrupting the solidification rate of the molten metal at the chill surface and recovering the separated portions. The two portions are separated by application of a tool or coating material on the chill casting surface at a desired location. The tool or coating material is adjustably applied across the width of the casting surface to control the width of the portion to be separated for scrap removal and/or to cast one or more specific width products.

The method aspect of the invention includes continuously drag casting molten metal into a cast strip by flowing a molten metal through a tundish onto a single rotating chill surface to solidify the molten metal into a cast strip, disrupting solidification of the molten metal along at least one circumferential line on the single rotating chill surface to form a longitudinal split in the cast strip. The longitudinal split separates the cast strip into at least two portions. In a preferred embodiment, the cast strip is split into a center portion and at least one edge portion thereby permitting accumulating the center portion on a mandrel while recovering the edge portion.

BRIEF DESCRIPTION OF THE DRAWINGS

Reference is now made to the Drawings accompanying the application wherein.

DESCRIPTION OF THE PREFERRED EMBODIMENTS

The invention provide improvements over prior art drag casting methods and apparatus by providing a coiled cast strip product having improved cross-sectional profile, shape and surface quality. The higher quality coiled cast strip yields additional benefits by eliminating defects which may cause production shut downs in subsequent processing of the cast strip.

The inventive edge trimming apparatus is adjustable across the width of the cast strip. Accordingly, the width of the trimmed scrap product can be adjusted to remove off-gauge edge portions as scrap. Alternatively, the adjustable edge trimming device can cast a specified cast strip width. The edge trimming device can be adjusted during the casting process such that the cast strip width can be changed while continuing to cast molten metal material into coiled strip form. This feature provides significant improvements in product yield since down time required for changing cast strip width is eliminated.

Figure 1:
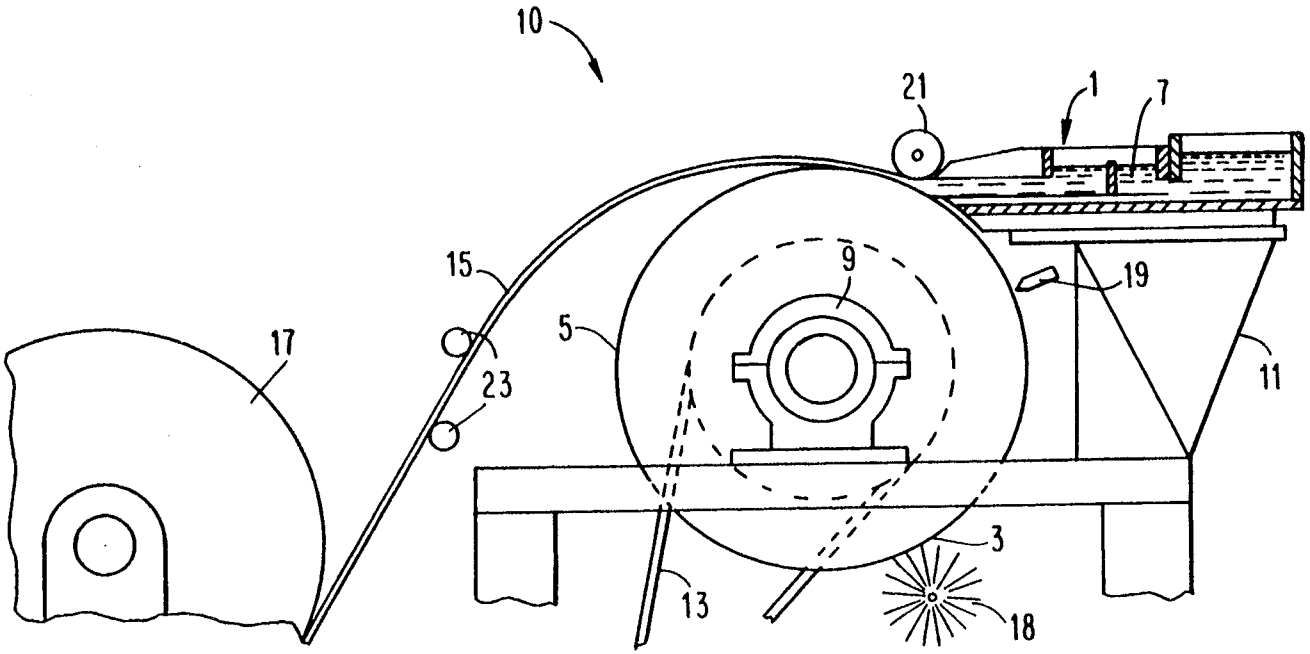
FIG. 1 PRIOR ART
FIG. 1 is a schematic diagram of a prior art continuous drag casting apparatus, with the tundish broken away to show greater detail.
Figure 2:
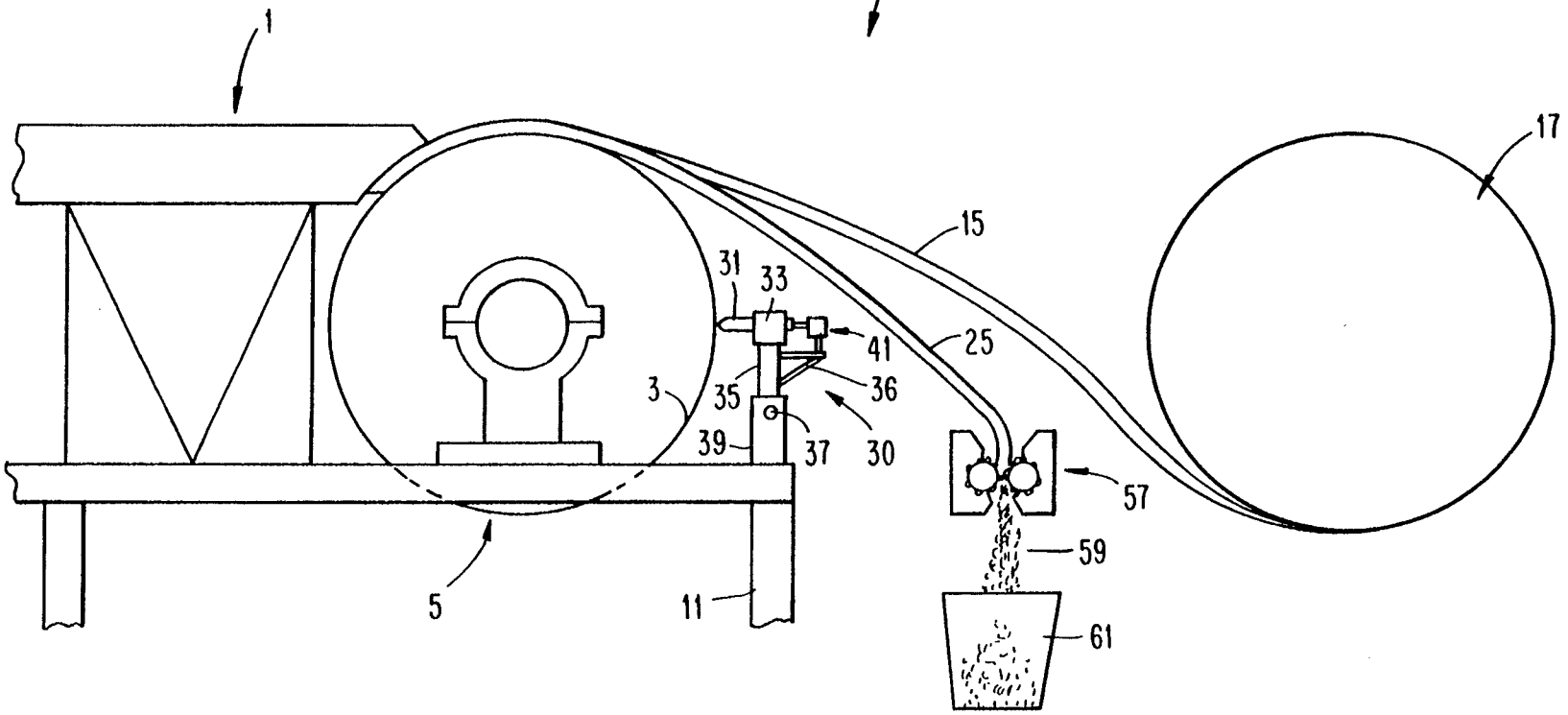
FIG. 2 is a schematic diagram of a drag casting apparatus according to the present invention.

With reference to FIG. 2, the apparatus for trimming edge scrap from continuously cast metal strip is generally designated by the reference numeral 20. A tundish 1 delivers molten metal to the casting surface 3 of the rotating casting wheel 5. The tundish 1 and casting wheel 5 are supported by framework 11.

A coiler 17 accumulates the product strip 15 into coil form for further processing. In addition to formation of the cast strip 15, a pair of edge scrap trim portions 25 are recovered as scrap material for further processing.

The edge trim portions 25 are formed by the edge trimming device generally designated as reference numeral 30. The edge trimming device 30 includes a tool 31 retained in a holder 33. In one embodiment, the tool 31 may be an inscribing tool which forms a scratch or groove on the surface 3 which effectively disrupts the solidification rate of the molten metal when contacting the casting surface 3. By disrupting the solidification rate, a split is formed between the strip 15 and edge portion 25. The split continues to propagate with rotation of the casting wheel 5 such that a separate edge portion 25 is produced concurrently with the product cast strip 15.

In an alternative embodiment, the tool 31 may be a coating material of graphite, plastic, teflon TM or other non-metallic material in an elongated form. When the elongated form is pressed against the casting surface 3, a line coating is produced which causes the disruption in solidification rate as described above. In this embodiment, application of a coating material does not affect the surface quality of the casting wheel 5. If the application of the coating material is terminated, any residual coating material left would burn off from the heat of the molten metal being cast. It should be understood that any coating material capable of disrupting the solidification rate may be utilized in conjunction with the rotating casting wheel 5. Moreover, application of the coating material in an elongated form is only exemplary and other modes of coating material application may be utilized in conjunction with the invention. For example, a line of coating material may be sprayed onto the casting surface 3 rather than applied as shown in FIG. 2.

Figure 4:
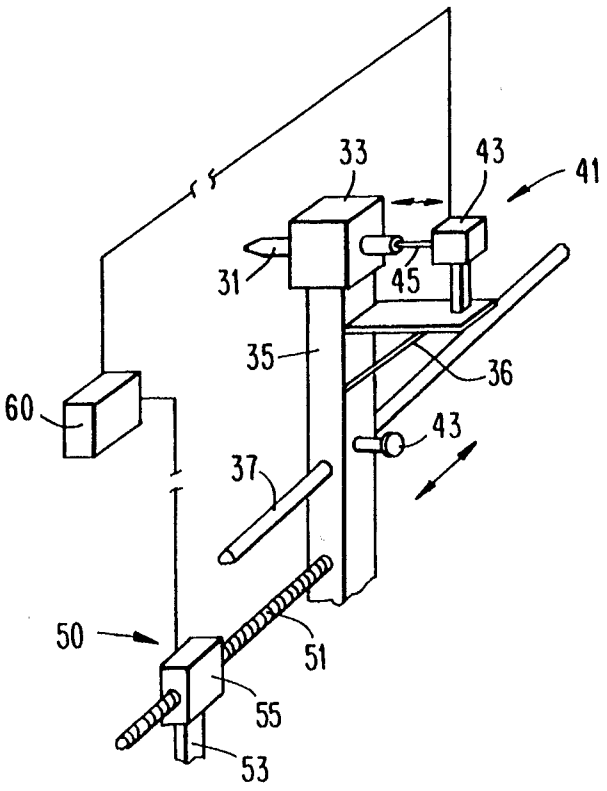
FIG. 4 is a perspective view of an exemplary tool used for trimming edge scrap from the cast strip.
Figure 3:
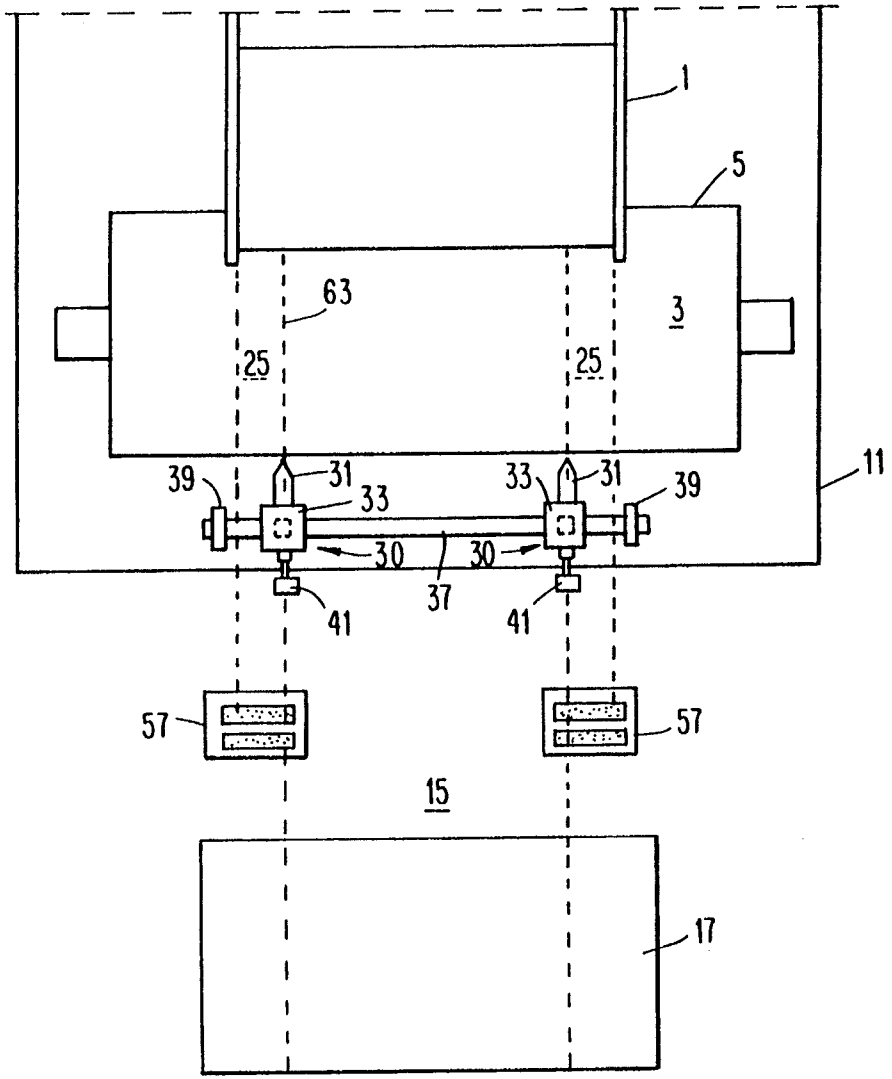
FIG. 3 is a top view of the apparatus depicted in FIG. 2 with the cast strip removed to show greater detail.

With reference now to FIGS. 2–4, the adjustable feature of the edge trimming tool 30 will now be described. The holder 33 is mounted on member 35. A rod 37 extends through an opening in the member 35 to permit reciprocal movement of the member 35 along the axis of the rod 37. The rod 37 is supported by mounts 39 that are supported by the caster framework 11.

As can be seen from FIG. 3, the casting apparatus includes a pair of edge trimming devices 30. Providing a pair of edge trimming devices facilitates removing edge scrap from each edge of the cast strip. However, and depending on the particular application contemplated, a single edge trimming device may be utilized to trim only one edge of the cast strip.

The edge trimming device 30 also includes a biasing device 41 mounted to the member 35 via the frame work 36. The biasing device 41 includes an actuator 43 and piston 45. The actuator 43 controls longitudinal movement of the piston 45 so as to bias the tool 31 against the casting surface 3. The piston 45 may be secured to the tool 31 to permit retraction of the tool 31 by the biasing device 41 when edge trimming is not desired. It should be understood that the tool 31 is designed to slidably extend through the holder 33 to permit extension or retraction by the biasing device 41.

Adjustment of the placement of the tool 31 at desired locations along the width of the casting surface 3 can be done either manually or using mechanical or automatic means. In a manual mode, and with reference to FIG. 4, the member 35 may be translated along the rod 37 until a desired location is reached. Location of the tool 31 may be secured by a set screw 43 extending through the member 35 to the rod 37. However, any known means for securing the tool 31 at a given location may be employed with the inventive apparatus.

With particular reference to FIG. 4, a motorized screw device 50 is shown rigidly attached to the member 35 via the screw 51. The screw device 50 may be mounted to the caster framework via the support member 53. A motor and gear arrangement 55 translate the screw 51 and the edge trimming device 30 along the width of the casting surface 3. In this manner, the position of the tool 31 against the casting surface 3 can be adjusted to modify the width of the edge trim portions and the overall width of the cast strip product. Further, the screw device 50 and edge trimming device 30 may be connected to the master control means 60 for controlling the continuous casting operation to permit adjustment of the edge trimming device while the casting operation is in progress.

It should be understood that other mechanical arrangements may be utilized in placing the tool 31 against the casting surface 3 in a desired location as well as providing the ability to change the tool position prior to or during a continuous casting operation. For example, other types of drives rather than the screw means disclosed may be employed for reciprocating the tool 31 across the width of the casting wheel 5, e.g. pneumatic or hydraulic types. Moreover, other types of biasing devices may be employed to control application of the tool 31 against the casting surface 3. For example, a spring biasing arrangement may be utilized in substitution for the actuator and piston-combination.

Once the edge trim portions 25 are separated from the cast strip 15, the edge trim portion is guided into a shredding device 57. The shredding device 57 may be any known shredding device such as a twin blade shear to comminute the continuously moving edge trim portion 25 into discrete segments. The discrete segments shown as reference numeral 59 are collected in a container 61 to be disposed of or recycled for further use.

The method of the present invention will now be described. Prior to the onset of delivering the molten metal to the tundish 1, the tools 31 are applied against the casting surface 3 establish the solidification disruption line 63, see FIG. 3. The casting wheel 5 is rotated fully such that the line 63 extends around the entire circumference of the wheel. Once the molten metal is delivered to the tundish and begins to flow onto the rotating casting wheel 5, a longitudinal split is formed at the line 63 to separate the edge trim portions 25 from the cast strip product 15. The casting run may be completed with the edge trimming device 30 in its initial location.

If a wider sheet of cast strip is desired, and the tools 31 are the type which are temporarily applied, the tools 31 are removed from the casting surface 3. After removal of the tools 31, any residual material on the casting wheel is burned off. After burn off, the disruption line is eliminated and a wider cast strip product is cast.

In an alternative mode, and while casting is in progress, the tools 31 may be translated along the width of the casting surface 3 to another location. For example, detection of the gauge of the cast strip may indicate that a wider portion of the casting strip still provides an acceptable gauge product 15. Thus, the adjustable tools 31 may be moved outwardly to narrow the width of the edge trim portion. Once the tools are positioned in their desired location and a solidification disruption line is established on the casting surface 3, a more narrow edge trim portion is formed without any disruption in the casting operation. Likewise, the tools 31 may be moved inwardly toward the center line of the tundish to increase the edge trim width portion if desired.

In yet another embodiment, a single tool 31 may be used to divide the cast strip into at least two acceptable quality strips. Alternatively, a plurality of tools 31 may be used to divide the strip into two or more acceptable quality strips with additional tools utilized for removing one or more edge portions.

The shredding devices 57, although not shown, may be adjustable with respect to the axis of the casting wheel 5. In this manner, the shredding devices 57 can accommodate varying widths of the overall cast product as well as different widths for the edge trim portion.

In an alternative embodiment, a coiling device may be substituted for the shredding device 57 to accumulate the edge trim portion 25 in a coil form. The coil of edge scrap can be recycled or disposed of as desired.

As such, an invention has been disclosed in terms of preferred embodiments thereof which fulfill each and every one of the objects of the present invention as set forth hereinabove and provide a new and improved method and apparatus for trimming edge scrap from continuously cast metal strip.

Various changes, modifications and alterations from the teachings of the present invention may be contemplated by those skilled in the art without departing from the intended spirit and scope thereof. Accordingly, it is intended that the present invention only be limited by the terms of the appended claims.

What is claimed is:

1. In a continuous casting apparatus comprising a tundish for receiving molten metal and for delivering the molten metal to a single rotating casting wheel having a chill casting surface of a selected width, wherein molten metal contacts said single rotating casting wheel and is cast as a continuous cast strip; the improvement comprising:

means for separating said cast strip into at least longitudinal two portions by disrupting the solidification rate of said molten metal at said chill surface, said means for separating further comprising:

i) a coating material capable of disrupting the solidification rate of said molten metal at said casting surface to cause a longitudinal separation in said cast strip;

ii) means for applying said coating material to said chill surface at at least one selected location along the width of said chill surface during rotation of said casting wheel to form said longitudinal separation; and means for recovering said at least two longitudinal portions, wherein said means for applying is adjustably located across the width of said chill surface so that a width of each recovered portion can be varied depending on a selected location for applying said coating material.

2. The apparatus of claim 1 wherein said coating material is an elongated member made from graphite, teflon TM or a plastic material.

3. The apparatus of claim 2 wherein said means for applying comprises:

i) a member spaced from said chill surface and arranged generally parallel thereto; and ii) a holder mounted to said member for translation along said width of said chill surface, said holder adapted to retain said elongated member during application of said elongated member to said chill surface; and iii) means to bias said elongated member against said chill surface.

4. The apparatus of claim 3 wherein said biasing means comprises a piston-driven actuator mounted to said member to bias said elongated member toward said chill surface.

5. A method of continuously drag casting molten metal into a cast strip comprising the steps of:

a) providing a coating material capable of disrupting the solidification rate of said molten metal at said casting surface to cause a longitudinal separation in said cast strip and means for applying said coating material to said chill surface at at least one selected location along the width of said chill surface during rotation of said casting wheel to form said longitudinal separation; wherein said means for applying is adjustably located across the width of said chill surface, b) flowing a molten metal through a tundish onto a single rotating chill surface to solidify said molten metal into a cast strip;

disrupting solidification of said molten metal along at least one circumferential line on said single rotating chill surface by applying said coating material during rotation of said chill surface to form a longitudinal split in said cast strip, said longitudinal split separating said cast strip into at least two longitudinal portions; and d) recovering said longitudinal portions.

6. The method of claim 5 wherein said molten metal is aluminum or an aluminum alloy.

7. The method of claim 5 comprising the step of forming a pair of circumferential lines on said single rotating chill surface to form a central portion and a pair of edge portions to remove excessive gauge portions of said cast strip.

8. The method of claim 5 comprising the step of forming a pair of said circumferential lines on said single rotating chill surface to form a pair of edge portions to produce a center portion of a preselected width.

9. The method of claim 5 wherein said coating material includes graphite, teflon TM, ink or plastic.

10. The method of claim 5 wherein said coating material is applied by a tool contacting said single rotating chill surface.

11. The method of claim 5 wherein said disrupting step is adjustable such that said longitudinal split can be formed at any location across the width of said single rotating chill surface to vary the width of each of said longitudinal portions.

12. The method of claim 5 wherein said cast strip is separated into at least one center portion and at least one edge portion and a said center portion is accumulated on a mandrel and a said edge portion is recovered.

13. The method of claim 12 wherein said cast strip is separated into two center portions and two edge portions.

* * * * *